US010050353B2

(12) United States Patent
Bank et al.

(10) Patent No.: US 10,050,353 B2
(45) Date of Patent: Aug. 14, 2018

(54) WIDE BAND ANTENNA

(71) Applicants: Michael Bank, Jerusalem (IL); Motti Haridim, Givat Zeev (IL)

(72) Inventors: Michael Bank, Jerusalem (IL); Motti Haridim, Givat Zeev (IL)

( * ) Notice: Subject to any disclaimer, the term of this patent is extended or adjusted under 35 U.S.C. 154(b) by 0 days.

(21) Appl. No.: 15/395,844

(22) Filed: Dec. 30, 2016

(65) Prior Publication Data

US 2018/0191084 A1 Jul. 5, 2018

(51) Int. Cl.

| | |
|---|---|
| ***H01Q 21/30*** | (2006.01) |
| ***H01Q 9/26*** | (2006.01) |
| ***H01Q 7/00*** | (2006.01) |
| ***H01Q 1/36*** | (2006.01) |

(52) U.S. Cl.

CPC ..... *H01Q 21/30* (2013.01); *H01Q 1/362* (2013.01); *H01Q 7/00* (2013.01); *H01Q 9/26* (2013.01); *H01Q 9/265* (2013.01)

(58) Field of Classification Search

CPC ..... H01Q 9/26; H01Q 7/00; H01Q 1/362; H01Q 21/30

USPC ..... 343/725, 795, 802, 803

See application file for complete search history.

(56) References Cited

U.S. PATENT DOCUMENTS

| | | | | |
|---|---|---|---|---|
| 7,358,906 | B2 * | 4/2008 | Sato | H01Q 1/243 343/700 MS |
| 8,164,532 | B1 * | 4/2012 | Brown | H01Q 7/00 343/756 |
| 8,998,099 | B2 * | 4/2015 | Frey | H01Q 1/2225 235/449 |
| 9,276,317 | B1 * | 3/2016 | Zheng | H01Q 5/364 |
| 9,614,282 | B1 * | 4/2017 | Zheng | H01Q 7/005 |
| 9,673,525 | B2 * | 6/2017 | Zheng | H01Q 9/04 |
| 2004/0222923 | A1 * | 11/2004 | Erkocevic | H01Q 1/243 343/700 MS |
| 2006/0071864 | A1 * | 4/2006 | Richard | H01Q 1/242 343/702 |
| 2008/0136720 | A1 * | 6/2008 | Parsche | H01Q 7/00 343/741 |
| 2008/0150811 | A1 * | 6/2008 | Honda | H01Q 9/40 343/702 |
| 2008/0227408 | A1 * | 9/2008 | Hsiao | H01Q 9/145 455/77 |
| 2009/0160717 | A1 * | 6/2009 | Tsutsumi | H01Q 9/16 343/726 |
| 2009/0237319 | A1 * | 9/2009 | Fukushima | H01Q 1/1271 343/848 |
| 2010/0097191 | A1 * | 4/2010 | Yamagajo | H01Q 1/2225 340/10.1 |
| 2010/0171676 | A1 * | 7/2010 | Tani | H01Q 1/243 343/803 |
| 2011/0018777 | A1 * | 1/2011 | Brown | H01Q 7/00 343/788 |
| 2012/0127047 | A1 * | 5/2012 | Gertenbach | H01Q 1/2283 343/745 |

(Continued)

*Primary Examiner* — Dameon E Levi
*Assistant Examiner* — Ab Salam Alkassim, Jr.
(74) *Attorney, Agent, or Firm* — Henry M. Feiereisen LLC

(57) ABSTRACT

A wide band antenna has a first radiator formed as an electrical field signal monopole radiator or a helix radiator, and a second radiator formed as an electric field folded dipole radiator or as a magnetic field loop radiator, with the first radiator radiating a signal at a lowest frequency and its odd harmonics and the second radiator radiating a signal at even harmonics of the lowest frequency.

5 Claims, 5 Drawing Sheets

(56) References Cited

U.S. PATENT DOCUMENTS

| | | | | |
|---|---|---|---|---|
| 2013/0016024 | A1* | 1/2013 | Shi | H01Q 1/243 343/833 |
| 2013/0057442 | A1* | 3/2013 | Brown | H01Q 1/48 343/750 |
| 2014/0097991 | A1* | 4/2014 | Zheng | H01Q 1/243 343/700 MS |
| 2015/0022401 | A1* | 1/2015 | Gavilan | H01Q 21/28 343/702 |
| 2015/0022411 | A1* | 1/2015 | Ali | H01Q 1/50 343/793 |
| 2015/0054699 | A1* | 2/2015 | Ali | H01Q 9/145 343/749 |
| 2015/0162660 | A1* | 6/2015 | Orsi | H01Q 7/00 343/848 |
| 2015/0364820 | A1* | 12/2015 | Dong | H01Q 5/10 343/729 |

* cited by examiner

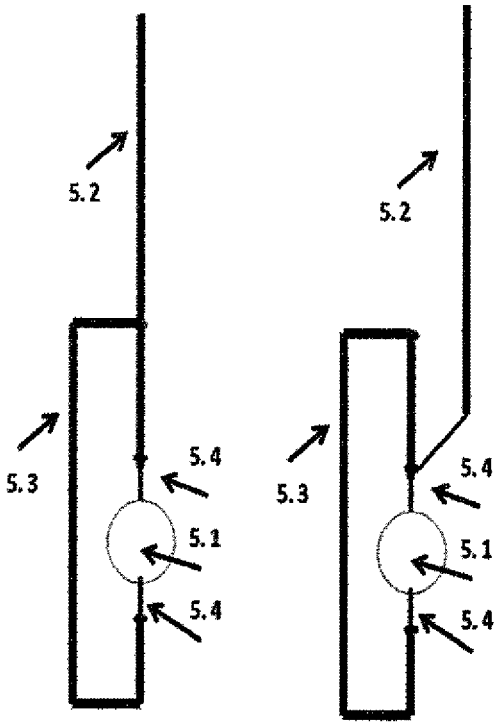
Fig. 5 A
Fig. 5 B
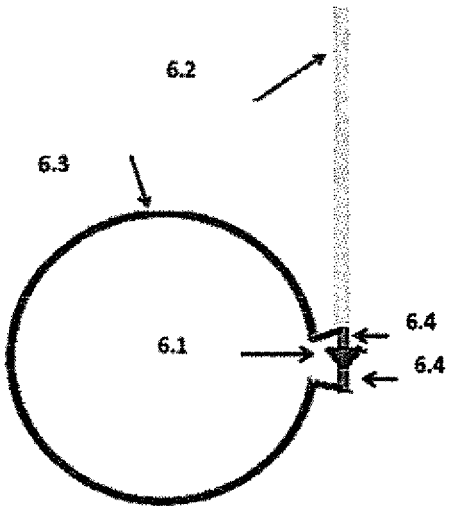
Fig 6

WIDE BAND ANTENNA

BACKGROUND OF THE INVENTION

The present invention relates to antennas and in particular to wide band antennas.

Modern communication system use multi-frequency devices. These multi-frequency devices need to use several antennas or wide band antennas. The known wide band antennas however have significant sizes. They are usually composed of a plurality of several narrow band radiators.

One of such knows antennas are a log periodic antenna shown in FIG. 1. It is composed of several dipoles. The width of the biggest dipole is somewhat greater than a half length of the lowest frequency. The height of the triangle composed of a group of the dipoles can be equal approximately to the length of wave having the lowest frequency. Because of significant sizes, such antennas cannot be used in compact transmission—reception devices, such as cellular telephones, feeds of satellite antennas, etc.

SUMMARY OF THE INVENTION

Accordingly, it is an object of the present invention to provide a wide band antenna which avoids the disadvantages of the known wide band antennas.

In keeping with these objects and with others which will become apparent hereinafter, one features of the present invention resides, briefly stated, in a wide band antenna which has two radiators, including a first radiator formed as an electric field monopole radiator or a helix radiator, and a second radiator formed as an electric field folded dipole radiator or a magnetic field loop radiator.

When the broad band antenna is designed in accordance with the present invention is constitutes an improvement over the known wide band antennas because it has a significantly smaller size.

According to another feature of the present invention, in the wide band antenna the first radiator has a length of substantially one quarter of a wave of the lowest frequency (F), while the second radiator is a folded dipole radiator adjusted to a second harmonic of the lowest frequency (2F) and has a perimeter of substantially half wave length at the lowest frequency.

According to a further feature of the present invention, in the wide band antenna the first and second radiators are configured so that on odd frequencies F, 3F, 5F, etc. the first radiator radiates satisfactory and the second radiator operates as an inverter formed as a delay line substantially half wave length, while on even frequencies 2F, 4F, 6F, etc. the second radiator radiates satisfactory while the first radiator does not radiate. On even harmonics the first radiator operates, but not very efficiently.

According to a further feature of the present invention, in the wide band antenna the second radiator is formed as a loop radiator radiating a magnetic field signal with a wave length substantially equal to a perimeter of a loop radiator, and on even frequencies 2F, 4F, 6F, etc. the second radiator radiates while the first radiator does not radiate.

According to a further feature of the present invention, in the wide band antenna the radiators can be supplied with signals from a single source or from a plurality of sources.

The novel features of the present invention are set forth in particular in the appended claims.

The invention itself however both as to its construction and its manner of operation will be best understood from the following description of the preferred embodiment which is accompanied by the following drawings.

BRIEF DESCRIPTION OF THE DRAWINGS

FIGS. 5*a* and 5*b* are views showing two embodiments of a wide band antenna WBMB according to the present invention with an inverter formed as a folded dipole antenna; and FIG. 6 is a view showing a wide band antenna WBMB according to the present invention with an inverter formed as a loop antenna;

DESCRIPTION OF THE PREFERRED EMBODIMENTS

A wide band antenna according to the present invention can be used in communications system, including such communication system and devices as transducers, cellular telephones, feeds for satellite antennas, etc.

Figure 1:
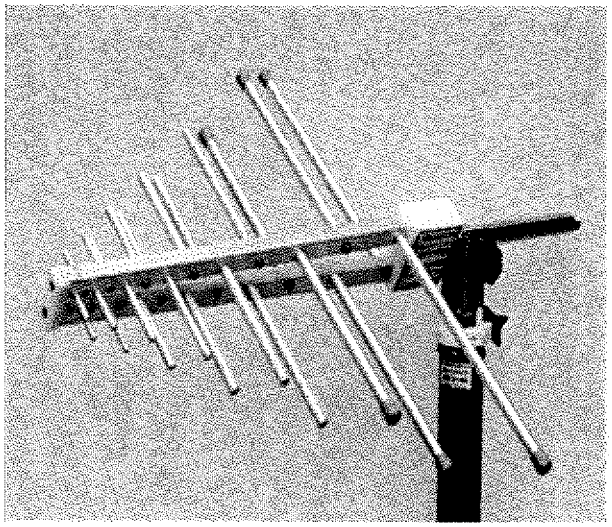
FIG. 1 of the drawings is a view showing an example of a known wide band log periodic antenna which is used in communication systems.
Figure 2:
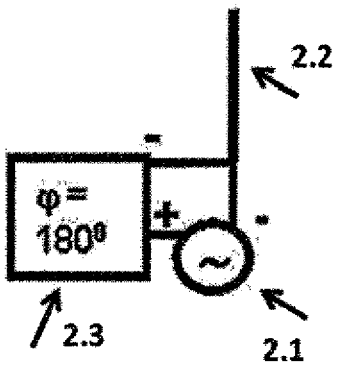
FIG. 2 is a view showing a known antenna which includes a signal source having one wire connected directly to a radiator and another wire connected to an inverter which is then connected to the radiator.

FIG. 2 shows an antenna (MB antenna) disclosed in our U.S. Pat. No. 9,419,327). It includes a signal source 2.1, a radiator 2.2, and an inverter 2.3. In this antenna the signal is supplied from the two-terminal source 2.1 so that from one terminal it is supplied directly to the radiator 2.2, while from the other terminal it is supplied to the radiator 2.3 through the inverter 2.3 which shifts the phase by 180 degrees to provide both signals in the same phase. This antenna can operate not only on frequency F, but also on all odd frequencies 3F, 5F, etc. because the inverter 2.3 is a delay line by 360° n+180°.

Abbreviations used in the description include WBMB which stands for a wide band Michael Bank antenna, and MB which stands for Michael Bank.

Figure 3:
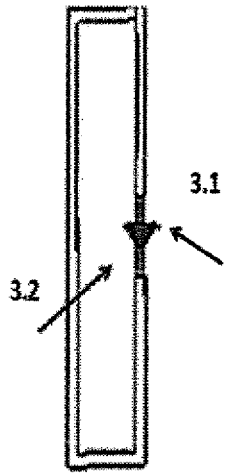
FIG. 3 is a view showing a folded dipole antenna which is known in the communication systems.

FIG. 3 shows a known folded dipole antenna as disclosed for example in RU 2192079C2, Pistohlkors, 1936. This folded dipole antenna can include a signal source 3.1 and a folded dipole 3.2.

Figure 4:
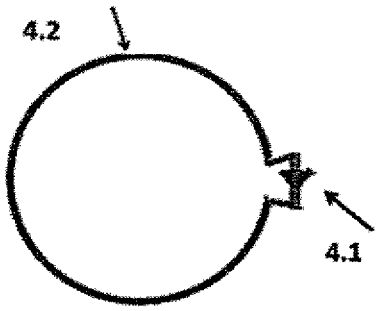
FIG. 4 is a view showing a loop antenna which is also known in communication systems.

FIG. 4 shows a known loop antenna. The loop antenna can include a signal source 4.1 and a loop 4.2.

FIGS. 5*a* and 5*b* show two embodiments of a wide band antenna WBMB of the present invention.

In the embodiment shown in FIG. 5*a* the wide band antenna can include a signal source 5.1, a radiator formed as a monopole 5.2, an inverter formed a folded dipole 5.3, one wire 5.4 extending from the signal source 5.1 directly to the radiator 5.2, and another wire 5.4 extending from the signal source 5.1 to the folded dipole 5.2, which in turn is connected to the radiator 5.2. The folded dipole 5.3 also operates as a second radiator on some frequencies. The monopole here is connected with the folded dipole in any places.

In the embodiment shown in FIG. 5*b* the wide band antenna can include a signal source 5.1, a radiator formed as a monopole 5.2, an inverter formed a folded dipole 5.3, one wire 5.4 extending from the signal source 5.1 to the radiator 5.2 and also to the folded dipole 5.3, and another wire 5.4 extending from the signal source 5.1 to the folded dipole 5.2, which in turn is connected to the radiator 5.2. The folded dipole 5.3 also operates as a second radiator on some frequencies. The monopole is connected here with the folded dipole at its connection with the source. The monopole here is also connected with the dipole, but in a certain place.

In accordance with still a further embodiment of wide band antenna of the present invention shown in FIG. 6, the wide band antenna can include a signal source 6.1, a radiator 6.2 formed as a monopole, an inverter formed as a loop 6.3 on some frequencies, two wires 6.4 extending from the signal source 6.1 to the loop 6.3 which in turn is connected to the radiator 6.2, and two wires 6.4 extending from the signal source 6.1 to the radiator 6.2. The loop 6.3 also operates as a second radiator on other frequencies.

Figure 7:
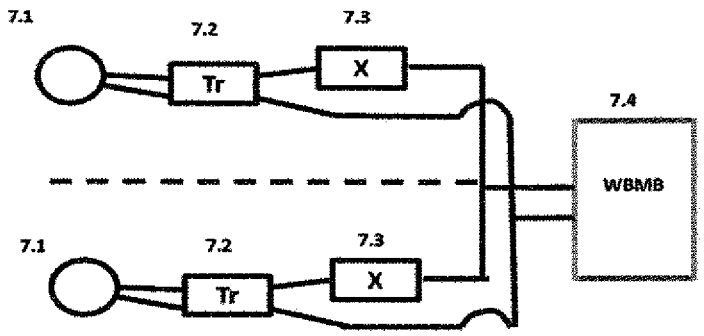
FIG. 7 is a view showing a wide band antenna WBMB according to the present invention with a possible connection to several sources working at different frequencies.

FIG. 7 shows the wide band antenna according to the present invention with a connection to one or more narrow band sources. A wide band antenna usually has a complex radiation resistance depending on frequency. In case of a narrow band source a transformer 7.2 can be used for providing active resistance and a reactance 7.3 of the antenna for compensating a reactive resistance of an antenna 7.4 In case of several sources operating at different partial frequencies bands, several blocks 7.1, 7.2, 7.3 can be used. Using different frequencies bands allows operations without an adder. Usually, the adder is a big problem in high frequency devices.

Figure 8:
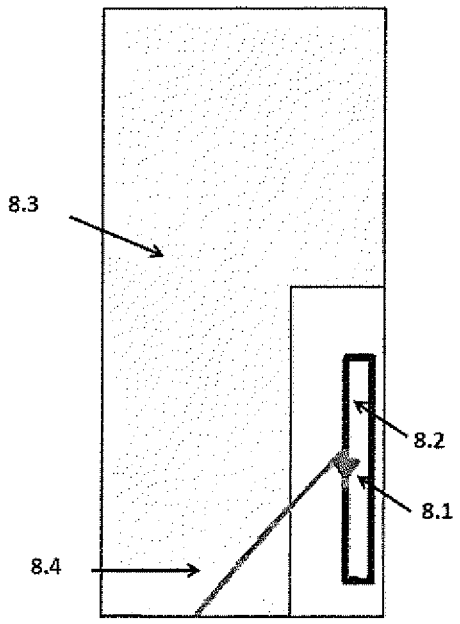
FIG. 8 is a view showing a wide band antenna WBMB according to a further embodiment of the present invention, with the printed board operating as a monopole.

FIG. 8 shows the wide band antenna according to a further embodiment of the present invention. It includes a signal source 8.1, a radiator formed as a folded dipole 8.2, a radiator formed as a monopole in form of a PCB 8.3 as in the MB antenna, and a single line 8.4 which supplies a signal as in the MB antenna In the wide band antenna according to the present invention the first radiator is a monopole which can be in form of a wire, a rod, or a wide plate. This is a monopole radiator with a length of substantially one quarter of a wave of the lowest frequency (F), while the second radiator is adjusted to a second harmonic of the lowest frequency (2F) and has a perimeter of substantially half wave length at the lowest frequency.

The first and second radiators are configured so that on odd frequencies F, 3F, 5F, etc. only the first radiator radiates and the second radiator operates as an inverter formed as a delay line substantially over half wave length, while on even frequencies 2F, 4F, 6F, etc. the second radiator radiates while the first radiator does not radiate.

The second radiator formed as a folded dipole can radiate an electric field signal at a frequency which corresponds to a wave length equal to substantially a length of a folded dipole perimeter and at its harmonics, while the second radiator formed as a loop radiator can radiate a magnetic field signal at a frequency which corresponds to a wave length equal to substantially a length of a perimeter of the loop radiator and at its harmonics.

The present invention is not limited to the details shown since various modifications and structural changes are possible without departing from the spirit of the present invention.

What is desired to be protected by Letters Patent is set forth in particular in the appended claims.

The invention claimed is:

1. A wide band antenna, comprising a single signal source;

and two radiators radiating alternatingly, and including a first radiator formed as an electrical field signal monopole radiator or a helix radiator and radiating on a frequency F, and a second radiator formed as an electric field folded dipole radiator or a magnetic loop radiator and radiating on a frequency 2F when the first radiator radiating on the frequency, so that when a signal with the frequency F is supplied to the antenna only the first radiator radiates this signal and when a signal with frequency 2 F is supplied to the antenna only the second radiator radiates this signal, and on odd frequencies only the first radiator radiates while the second radiator formed as an inverter formed as a delay line, while on even frequencies the second radiator radiates while the first radiator does not radiate, wherein on odd frequencies F, 3F, 5F, etc. only the first radiator radiates and the second radiator operates as the inverter of a signal of the first radiator and is formed as the inverter and the delay line of half wave length of a lowest frequency (F) while on even frequencies 2F, 4F, 6F, etc. the second radiator radiates while the first radiator does not radiate, and the signal is supplied to the monopole consecutively through the second radiator, while the second radiator operates as the inverter formed as the delay line of half wave length.

2. The wide band antenna of claim 1, wherein the first radiator is a monopole radiator with a length of substantially one quarter of a wave of a lowest frequency (F).

3. The wide band antenna of claim 1, wherein the second radiator is a folded dipole radiator adjusted to a second harmonic (2F) of the lowest frequency (F) and has a perimeter of substantially half wave length at the lowest frequency (F).

4. The wide band antenna of claim 1, wherein the second radiator which is a folded dipole radiator is configured to operate as an inverter at a lowest frequency (F) and all odd frequencies (2n+1) F.

5. A wide band antenna, comprising two radiators radiating alternatingly, including a first radiator and a second radiator, wherein the first radiator is a radiator with a length of substantially one quarter of a wave of a lowest frequency (F), while the second radiator is a folded dipole radiator adjusted to a second harmonic (2F) of a lowest frequency (F) and has a perimeter of substantially half wave length at the lowest frequency (F), so that when a signal with the frequency F is supplied to the antenna only the first radiator radiates this signal and when a signal with frequency 2 F is supplied to the antenna only the second radiator radiates this signal, wherein on odd frequencies F, 3F, 5F, etc. only the first radiator radiates and the second radiator operates as an Inverter of a signal of the first radiator and is formed as a delay line of half wave length of a lowest frequency (F) while on even frequencies 2F, 4F, 6F, etc. the second radiator radiates while the first radiator does not radiate, and the signal is supplied to the monopole consecutively through the second radiator, while the second radiator operates as the inverter formed as the delay line of half wave length.

* * * * *